US006334537B1

(12) United States Patent
Tepper

(10) Patent No.: US 6,334,537 B1
(45) Date of Patent: Jan. 1, 2002

(54) INFLATABLE CONTAINER FOR PROTECTING AN ITEM PACKAGED THEREIN

(76) Inventor: Daniel A. Tepper, 67 Belden Hill Rd., Wilton, CT (US) 06897

( * ) Notice: Subject to any disclaimer, the term of this patent is extended or adjusted under 35 U.S.C. 154(b) by 0 days.

(21) Appl. No.: 09/553,732

(22) Filed: Apr. 20, 2000

(51) Int. Cl.[7] ..... B65D 81/02
(52) U.S. Cl. ..... 206/522; 206/315.1; 383/3
(58) Field of Search ..... 206/315.1, 522, 206/523, 591, 592, 594; 383/3; 224/917; 220/4.21, 4.22–4.24

(56) References Cited

U.S. PATENT DOCUMENTS 4,099,656 A * 7/1978 Neumann et al. ..... 383/3
4,287,250 A 9/1981 Rudy
4,569,082 A * 2/1986 Ainsworth et al. ..... 206/522
4,573,202 A * 2/1986 Lee ..... 206/522
4,762,225 A 8/1988 Henkel
4,801,213 A * 1/1989 Frey et al. ..... 206/522
4,905,835 A 3/1990 Pivert et al.
5,094,344 A 3/1992 Savage
5,193,677 A * 3/1993 Moreno ..... 206/315.1
5,316,386 A * 5/1994 Moore ..... 383/3
5,421,454 A * 6/1995 Chern ..... 206/522
5,494,157 A 2/1996 Golenz et al.
5,564,570 A * 10/1996 Jaszai ..... 206/522

* cited by examiner

*Primary Examiner*—Luan K. Bui
(74) *Attorney, Agent, or Firm*—Bacon & Thomas

(57) ABSTRACT

An inflatable container for protecting an item packaged therein that includes a shell, a plurality of air bladders, and an inflater. The shell is hollow and made of a flexible material so as to have both a collapsed mode when not in use and an inflated mode when in use. The plurality of air bladders line the shell entirely, are in fluid communication with each other, but independently movable relative to each other for conforming to the item. The inflator includes a flap valve that is disposed in a throughbore in the shell, and is in fluid communication with, and selectively allows inflation of, the plurality of air bladders, a nipple that replaceably extends through the flap valve, a manual valve that is attached to the nipple, a length of hose that is attached to, and is in fluid communication with, the manual valve, and a manual accordion style bellows foot pump that is attached to, and is in fluid communication with, the length off hose. When the nipple is extended through the flap valve, and the manual valve is opened, the manual accordion style bellows foot pump is repeatedly stepped on and inflates the plurality of air bladders.

26 Claims, 2 Drawing Sheets

FIG.3
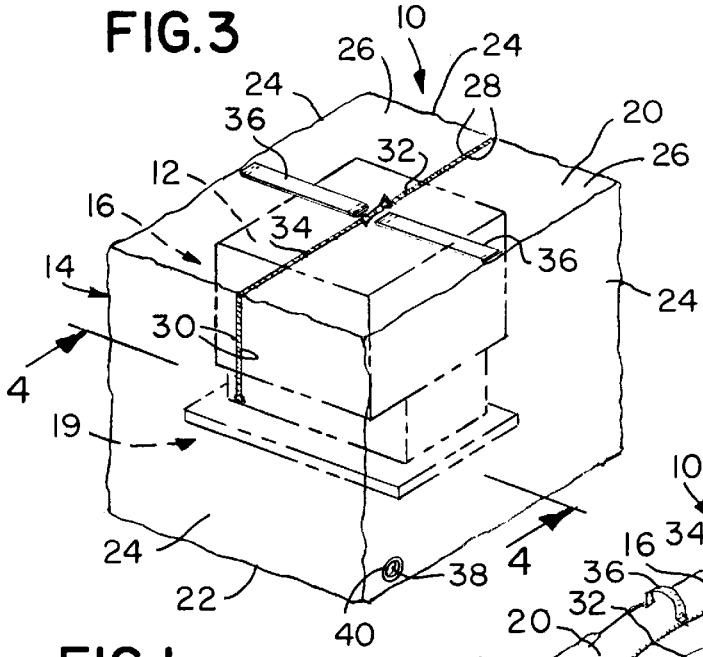
FIG.1
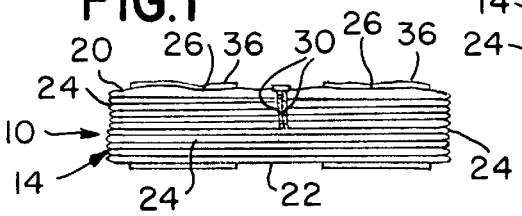
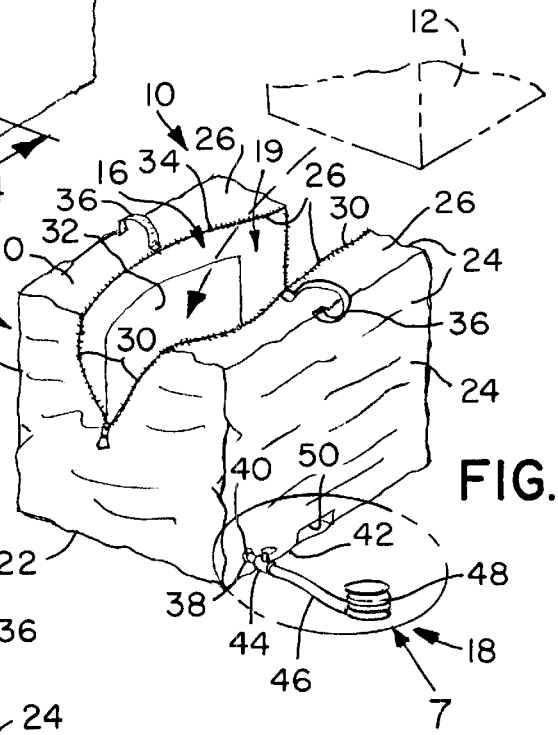
FIG.2
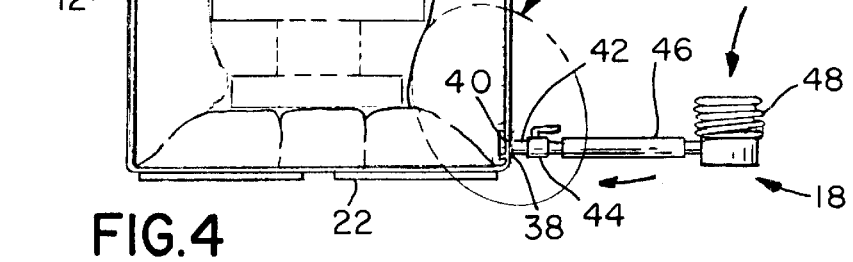
FIG.4

FIG. 5
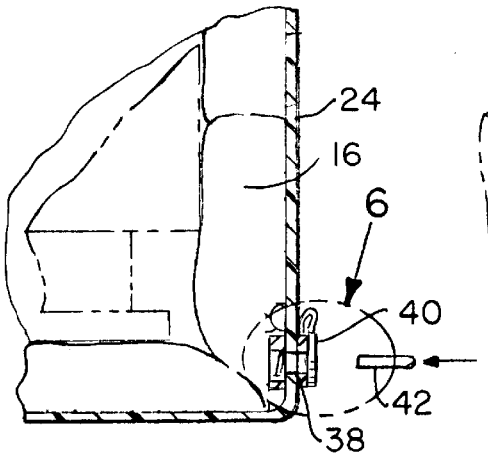
FIG. 7
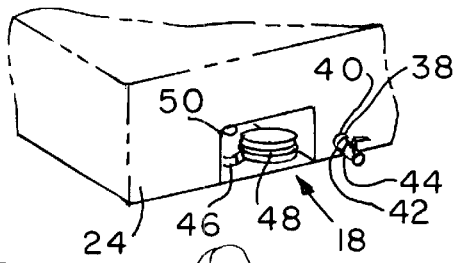
FIG. 6
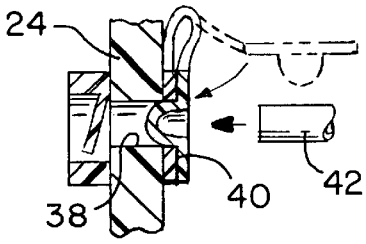
FIG. 8
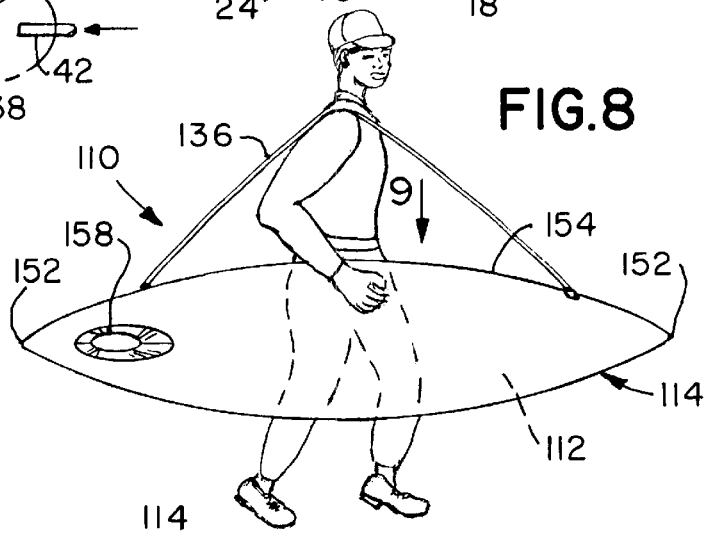
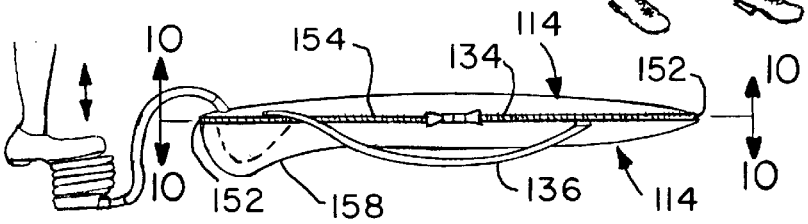
FIG. 9
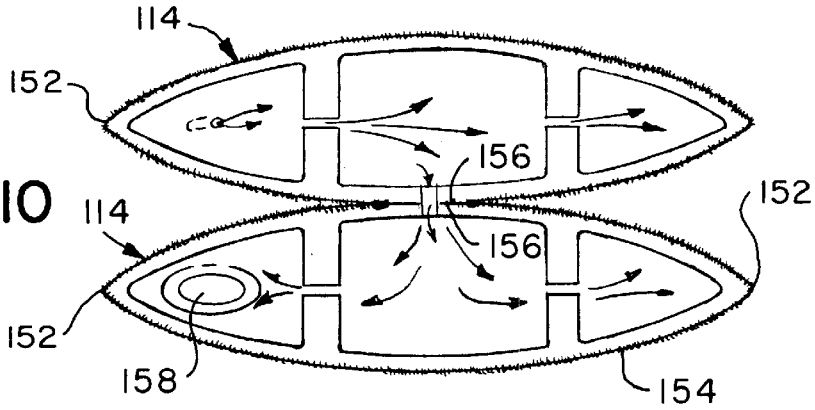
FIG. 10

INFLATABLE CONTAINER FOR PROTECTING AN ITEM PACKAGED THEREIN

BACKGROUND OF THE INVENTION

1. Field of the Invention

The present invention relates to an inflatable container. More particularly, the present invention relates to an inflatable container for protecting an item packaged therein.

2. Description of the Prior Art

Numerous innovations for item protection devices have been provided in the prior art that will be described. Even though these innovations may be suitable for the specific individual purposes to which they address, however, they differ from the present invention.

A FIRST EXAMPLE, U.S. Pat. No. 4,287,250 to Rudy teaches devices for packaging and/or cushioning products and objects, the devices including permeable elastomeric sheets sealed together at predetermined locations to form separate and discrete chambers, or intercommunicating chambers, inflated initially with a gaseous medium comprising a gas other than air, oxygen or nitrogen which has a very low diffusion rate from each chamber through the elastomeric sheets, ambient air diffusing more readily through the sheets into each inflated chamber to provide a total pressure therein which is the sum of the partial pressure of the air in the chamber and the partial pressure of the gas in the chamber. Not only does the air diffusing into a chamber increase the total pressure therein above the initial inflation pressure of the gas, but the air in the chamber inhibits outward diffusion of the gas from the chamber or compensates for any loss of pressure caused by such outward diffusion of the gas.

A SECOND EXAMPLE, U.S. Pat. No. 4,762,225 to Henkel teaches a guard and carrying system for compact discs. The system includes a collapsible enclosure having a mouth portion, extensible side portions, a V-shaped vertex portion, and a securable fold-over cover. Also included is an accordion-like integral series of V-shaped storage elements. These elements include an elongated, substantially rigid, yet foldable substrate. They further include an integral sleeve having a longitudinal axis and enveloping the substrate, trapping air in a planar geometry, and several outer sleeve segments disc-proportioned and disposed about the integral sleeve holding air between these segments and the integral sleeve. A plurality of linear heat seal are disposed transversely to the longitudinal axis of the integral sleeve. The heat seals bond the outer segments to the integral sleeve to define a pattern of pockets adapted for the holding of discs and disc-related documentation. The linear heat seals also act to define a plurality of planar air cushions between the integral sleeve and substrate, thereby creating a planar air cushion that will act to protect the discs from external pressures and impacts.

A THIRD EXAMPLE, U.S. Pat. No. 4,905,835 to Pivert et al. teaches packaging of the type comprising an outer rectangular box of rigid cardboard or the like, and a flexible inflatable structure situated inside the box and comprising, overlying each of the inside face of the box, an inflatable cushion for coming into close contact with the article to be packaged. The box includes a bottom closure and a top closure each having self-locking flaps. The inflatable structure comprises two unit assemblies each comprising a central cushion overlying a respective one of the closures of the box, and two side cushions overlying respective side walls of the box, with each assembly further including means for simultaneously inflating its three cushions, with at least one of the assemblies being inflatable from outside the box. The bottom and top closures of the box are held in the locked position by the pressure exerted thereon by the respective central cushions of the two assemblies of the inflatable structure, once inflated.

A FOURTH EXAMPLE, U.S. Pat. No. 5,494,157 to Golenz et al. teaches a computer case that provides a main packing space for the microcomputer defined by a "C" shaped rigid frame and corresponding shock absorbing pad, the forth side of the packing space is selectively closed by a padded access door. The handle and/or shoulder strap is riveted to the upper side of this "C" shaped frame. The access door is integrally hinged to the lower side of the frame, and is secured to the case when closed by double slide fastener and hook and loop fasteners.

It is apparent that numerous innovations for item protection devices have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide an inflatable container for protecting an item packaged therein that avoids the disadvantages of the prior art.

ANOTHER OBJECT of the present invention is to provide an inflatable container for protecting an item packaged therein that is simple and inexpensive to manufacture.

STILL ANOTHER OBJECT of the present invention is to provide an inflatable container for protecting an item packaged therein that is simple to use.

BRIEFLY STATED, YET ANOTHER OBJECT of the present invention is to provide an inflatable container for protecting an item packaged therein that includes a shell, a plurality of air bladders, and an inflater. The shell is hollow and made of a flexible material so as to have both a collapsed mode when not in use and an inflated mode when in use. The plurality of air bladders line the shell entirely, are in fluid communication with each other, but independently movable relative to each other for conforming to the item. The inflator includes a flap valve that is disposed in a throughbore in the shell, and is in fluid communication with, and selectively allows inflation of, the plurality of air bladders, a nipple that replaceably extends through the flap valve, a manual valve that is attached to the nipple, a length of hose that is attached to, and is in fluid communication with, the manual valve, and a manual accordion style bellows foot pump that is attached to, and is in fluid communication with, the length of hose. When the nipple is extended through the flap valve, and the manual valve is opened, the manual accordion style bellows foot pump is repeatedly stepped on and inflates the plurality of air bladders.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows:

FIG. 1 is a diagrammatic front elevational view of a first embodiment of the present invention prior to use and in the collapsed mode;

FIG. 2 is a diagrammatic perspective view of the present invention in the inflated mode and ready for use;

FIG. 3 is a diagrammatic perspective view of the present invention in the inflated mode and in use;

FIG. 4 is a diagrammatic cross sectional view taken on line 4—4 in FIG. 3;

FIG. 5 is an enlarged diagrammatic cross sectional view of the area generally enclosed by the dotted curve identified by arrow 5 in FIG. 4;

FIG. 6 is an enlarged diagrammatic cross sectional view of the area generally enclosed by the dotted curve identified by arrow 6 in FIG. 5;

FIG. 7 is an enlarged diagrammatic perspective view of the area generally enclosed by the dotted curve identified by arrow 7 in FIG. 2;

FIG. 8 is a diagrammatic side elevational view of a second embodiment in the inflated mode and in use;

FIG. 9 is a diagrammatic side elevational view taken generally in the direction of arrow 9 in FIG. 8; and FIG. 10 is a diagrammatic cross sectional view taken on line 10—10 in FIG. 9.

LIST OF REFERENCE NUMERALS UTILIZED IN THE DRAWING

First Embodiment

10 inflatable container of the present invention for protecting item 12 packaged therein
12 item
14 shell for holding item 12
16 plurality of air bladders for cushioning item 14
18 inflater
20 top wall of shell 14
22 bottom wall of shell 14
24 four side walls of shell 14
26 pair of halves of top wall 20 of shell 14
28 facing edges of pair of halves 26 of top wall 20 of shell 14
30 facing edges of split in each side wall of a pair of opposing side walls of four side walls 24 of shell 14
32 generally U-shaped opening in shell 14 for allowing access to item 12
34 zipper selectively maintaining generally U-shaped opening 32 in shell 16 selectively closed
36 pair of handles on top wall 20 of shell 14 for carrying inflatable container 10
38 throughbore of inflator 18 through one side wall 24 of four side walls 24 of shell 14
40 flap valve of inflator 18
42 nipple of inflator 18
44 manual valve of inflator 18
46 length of hose of inflator 18
48 manual accordion style bellows foot pump of inflator 18
50 cavern of inflator 18 in one side wall 24 of four side walls 24 of shell 14

Second Embodiment

110 inflatable container of the present invention for protecting surf board 112 packaged therein
112 surf board
113 fin of surf board 112
114 pair of shell halves
134 pair of zippers
136 shoulder strap for carrying inflatable container 110
152 pointed ends of each shell half of pair of shell halves 114
154 perimeter of each shell half of pair of shell halves 114
156 widest point of each shell half of pair of shell halves 114
158 protector for conforming to, and protecting, fin 113 of surf board 112

DETAILED DESCRIPTION OF THE PREFERRED EMBODIMENT

Referring now to the figures, in which like numerals indicate like parts, and particularly to FIGS. 1–3, a first embodiment of the inflatable container of the present invention is shown generally at 10 for protecting an item 12 packaged therein, prior to use and in an collapsed mode, in an inflated mode and ready for use, and in the inflated mode and in use, respectively.

The overall configuration of the inflatable container 10 can best be seen in FIGS. 1–3, and as such, will be discussed with, reference thereto.

The inflatable container 10 comprises a shell 14 for holding the item 12, and a plurality of air bladders 16 that are disposed in the shell 14 for cushioning the item 14.

The inflatable container 10 further comprises an inflater 18 that is in fluid communication with, and selectively inflates, the plurality of air bladders 16.

The inflator container 10 further comprises a lining 19 that is soft foam and lines the shell and has the plurality of air bladders built therein.

The specific configuration of the shell 14 can best be seen in FIGS. 1–4, and as such, will be discussed with reference thereto.

The shell 14 is, by definition, hollow, and is made of a flexible material so as to have both a collapsed mode when not in use and an inflated mode when in use.

The flexible material that the shell 14 is made of is heavy gauge, light weight, puncture resistant nylon.

The shell 14 is cubic-shaped, and by definition, has a top wall 20, a bottom wall 22, and four side walls 24.

The top wall 20 of the shell 14 is split into a pair of halves 26 that have facing edges 28.

Each side wall of a pair of opposing side walls 24 of the shell 14 is partially split, from the top wall 20 of the shell 14 to half-way down a respective side wall of the pair of opposing side walls 24 of the shell 14, into a pair of facing edges 30.

The pair of facing edges 30 of each side wall of the pair of opposing side walls 24 of the shell 14 are continuous with the facing edges 28 of the pair of halves 26 of the top wall 20 of the shell 14, respectively, and together therewith, define a generally U-shaped opening 32 for allowing access to the item 12.

The generally U-shaped opening 32 in the shell 16 is maintained selectively closed by a zipper 34 that extends along the pair of facing edges 30 of each side wall of the pair of opposing side walls 24 of the shell 14 and the facing edges 28 of the pair of halves 26 of the top wall 20 of the shell 14.

The top wall 20 of the shell 14 has a pair of handles 36 that extend flexibly thereacross, perpendicularly from the facing edges 28 of the pair of halves 26 of the top wall 20 of the shell 14 to a respective side wall 24 of the shell 14 for carrying the inflatable container 10.

The specific configuration of the plurality of air bladders 16 can best be seen in FIGS. 2 and 4, and as such, will be discussed with reference thereto.

The plurality of air bladders 16 line the shell 14 entirely, are in fluid communication with each other, but independently movable relative to each other for conforming to the item 12, and separate along the generally U-shaped opening 32 in the shell 14 for allowing access to the item 12.

The specific configuration of the inflator 18 can best be seen in FIGS. 2–7, and as such, will be discussed with reference thereto.

The inflator 18 comprises one side wall 24 of the shell 14 having a throughbore 38 that is disposed in close proximity to an adjacent side wall 24 of the shell 14 and the bottom wall 22 of the shell 14.

The inflator 18 further comprises a flap valve 40 that is disposed in the throughbore 38 in the one side wall 24 of the shell 14, and is in fluid communication with, and selectively allows inflation of, the plurality of air bladders 16.

The inflator 18 further comprises a nipple 42 that. replaceably extends through the flap valve 40 of the inflator 18.

When the nipple 42 of the inflator 18 is extended through the flap valve 40 of the inflator 18, the nipple 42 of the inflator 18 opens the flap valve 40 of the inflator 18 and the nipple 42 of the inflator 18 becomes fluidly communicating with the plurality of air bladders 16.

When the nipple 42 of the inflator 18 is removed from the flap valve 40 of the inflator 18, the flap valve 40 of the inflator 18 is closed, sealing the plurality of air bladders 16.

The inflator 18 further comprises a manual valve 44 that is attached to the nipple 42 of the inflator 18.

When the manual valve 44 of the inflator 18 is opened, the manual valve 44 of the inflator 18 is in fluid communication with the nipple 42 of the inflator 18.

When the manual valve 44 of the inflator 18 is closed, the manual valve 44 of the inflator 18 is not in fluid communication with the nipple 42 of the inflator 18.

The inflator 18 further comprises a length of hose 46 that: is attached to, and is in fluid communication with, the manual valve 44 of the inflator 18.

The inflator 18 further comprises a manual accordion style bellows foot pump 48 that is attached to, and is in fluid communication with, the length of hose 46 of the inflator 18.

When the nipple 42 of the inflator 18 is extended through the flap valve 40 of the inflator 18, and the manual valve 44 of the inflator 18 is opened, the manual accordion style bellows foot pump 48 of the inflator 18 in repeatedly stepped on and inflates the plurality of air bladders 16.

The inflator 18 further comprises the one side wall of the shell 14 having a recess 50 therein, adjacent to the throughbore 38, and which houses and stores the nipple 42, the manual valve 44, the length of hose 46, and the manual accordion style bellows foot pump 48 of the inflator 18, as a unit when removed from the flap valve 40.

The configuration of a second embodiment of the inflatable container 110 of the present invention can best be seen in FIGS. 8–10, and as such, will be discussed with reference thereto.

The inflatable container 110 is similar to the inflatable container 10, except:

1) The item 12 is a surf board 112 with a fin 113.
2) The shell 14 is formed of a pair of shell halves 114.
3) Each shell half 114 is flat and substantially oval-shaped with pointed ends 152, a perimeter 154, and a widest point 156 for conforming to the surf board 112.
4) The pair of shell halves 114 are foldably attached to each other at the widest point 156 of each shell half 114.
3) The zipper 34 is replaced by a pair of zippers 134 that extend along the perimeter 154 of each shell half 114.
4) One shell half 114 has, in close proximity to one pointed end 152 thereof, a protector 158 that depends therefrom for conforming to, and protecting, the fin 113 of the surf board 112.
5) The protector 158 is made of hard plastic.
6) The pair of handles 36 are replaced by a shoulder strap 136 that extends from the perimeter 154 of one shell half 114, in close proximity to the pointed ends 152 of the one shell half 114.

It will be understood that each of the elements described above, or two or more together, may also find a useful application in other types of constructions differing from the types described above.

While the invention has been illustrated and described as embodied in an inflatable container for protecting an item packaged therein, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. An inflatable container for protecting an item packaged therein, comprising:

a) a shell for holding the item;

b) a plurality of air bladders disposed in said shell for cushioning the item;

c) an inflator including a pump arranged to be placed in fluid communication with and to selectively inflate said plurality of air bladders; and d) a recess in said shell, wherein said pump is separable from said plurality of air bladders, and wherein said recess is arranged to accommodate said pump when said pump is separated from and no longer in fluid communication with said plurality of air bladders.

2. The container as defined in claim 1, wherein said shell is hollow, and is made of a flexible material so as to have both a collapsed mode when not in use and an inflated mode when in use.

3. The container as defined in claim 2, wherein said flexible material that said shell is made of is heavy gauge, light weight, puncture resistant nylon.

4. The container as defined in claim 1, wherein said inflator comprises a throughbore through said shell.

5. The container as defined in claim 4, wherein said inflator further comprises a flap valve that is disposed in said throughbore in said shell, and is in fluid communication with, and selectively allows inflation of, said plurality of air bladders.

6. The container as defined in claim 5, wherein said inflator further comprises a nipple that replaceably extends through said flap valve of said inflator, and when said nipple of said inflator is extended through said flap valve of said inflator, said nipple of said inflator opens said flap valve of said inflator, and said nipple of said inflator becomes fluidly communicating with said plurality of air bladders, and when said nipple of said inflator is removed from said flap valve of said inflator, said flap valve of said inflator is closed, sealing said plurality of air bladders.

7. The container as defined in claim 6, wherein said inflator further comprises a manual valve that is attached to said nipple of said inflator, and when said manual valve of said inflator is opened, said manual valve of said inflator is in fluid communication with said nipple of said inflator, and when said manual valve of said inflator is closed, said manual valve of said inflator is not in fluid communication with said nipple of said inflator.

8. The container as defined in claim 7, wherein said inflator further comprises a length of hose that is attached to, and is in fluid communication with, said manual valve of said inflator.

9. The container as defined in claim 8, wherein said pump is a manual accordion style bellows foot pump that is attached to, and it in fluid communication with, said length of hose of said inflator, and when said nipple of said inflator is extended through said flap valve of said inflator, and said manual valve of said inflator is opened, said manual accordion style bellows foot pump of said inflator is repeatedly stepped on and inflates said plurality of air bladders.

10. The container as defined in claim 1, wherein said plurality of air bladders line said shell entirely, are in fluid communication with each other, but independently movable relative to each other for conforming to the item.

11. The container as defined in claim 9, wherein said shell is cubic-shaped, and by definition, has:

a) a top wall;

b) a bottom wall; and c) four side walls.

12. The container as defined in claim 11, wherein said top wall of said shell is split into a pair of halves that have facing edges.

13. The container as defined in claim 11, wherein each side wall of a pair of opposing side walls of said shell is partially split, from said top wall of said shell to half-way down a respective side wall of said pair of opposing side walls of said shell, into a pair of facing edges.

14. The container as defined in claim 13, wherein said pair of facing edges of each side wall of said pair of opposing side walls of said shell are continuous with said facing edges of said pair of halves of said top wall of said shell, respectively, and together therewith, define a generally U-shaped opening for allowing access to the item.

15. The container as defined in claim 14, wherein said plurality of bladders separate along said generally U-shaped opening in said shell for allowing access to the item.

16. The container as defined in claim 14, wherein said generally U-shaped opening in said shell is maintained selectively closed by a zipper that extends along said pair of facing edges of each side wall of said pair of opposing side walls of said shell and said facing edges of said pair of halves of said top wall of said shell.

17. The container as defined in claim 12, wherein said top wall of said shell has a pair of handles that extend flexibly thereacross, perpendicularly from said facing edges of said pair of halves of said top wall of said shell to a respective side wall of said shell for carrying said inflatable container.

18. The container as defined in claim 11, wherein said inflator comprises one side wall of said shell having a throughbore that is disposed in close proximity to an adjacent side wall of said shell and said bottom wall of said shell.

19. The container as defined in claim 18, wherein said inflator further comprises said one side wall of said shell having a cavern therein, adjacent to said throughbore therein, and which houses and stores said nipple of said inflator, said manual valve of said inflator, said length of hose of said inflator, and said manual accordion style bellows foot pump of said inflator, as a unit when removed from said flap valve of said inflator.

20. The container as defined in claim 1, wherein said shell is formed of a pair of shell halves.

21. An inflatable container for protecting an item packaged therein, comprising:

e) a shell including a pair of shell halves for holding the item;

f) a plurality of air bladders disposed in said shell for cushioning the item; and g) an inflator including a pump arranged to be placed in fluid communication with and to selectively inflate said plurality of air bladders, wherein each shell half is flat and substantially oval-shaped for conforming to a surf board with a fin, each said shell half having ends and a widest point between said ends, and wherein said plurality of air bladders are arranged to cover substantially an entire interior surface of both said shell halves.

22. The container as defined in claim 21, wherein said pair of shell halves are foldably attached to each other at said widest point of each shell half.

23. The container as defined in claim 21, wherein said perimeter of each shell half has extending therealong a pair of zippers.

24. The container as defined in claim 21, wherein one shell half has, in close proximity to one pointed end thereof, a protector that depends therefrom for conforming to, and protecting, the fin of the surf board.

25. The container as defined in claim 24, wherein said protector is made of hard plastic.

26. The container as defined in claim 21, wherein one shell half has a shoulder strap that extends from said perimeter thereof, in close proximity to said pointed ends thereof.

* * * * *